US005806299A

United States Patent [19]

Bauermeister et al.

[11] Patent Number: 5,806,299

[45] Date of Patent: Sep. 15, 1998

[54] PROCESS AND APPARATUS FOR QUICKLY SWITCHING OVER FROM PREMIX COMBUSTION TO DIFFUSION COMBUSTION IN A GAS TURBINE

[75] Inventors: Kurt Bauermeister, Mülheim a.d. Ruhr; Michael Brodmann, Hünxe; Peter Küper, Gladbeck; Jürgen Moroni, Oberhausen; Hans Weibel, Geldern, all of Germany

[73] Assignee: MAN Gutehoffnungshütte Aktiengesellschaft, Oberhausen, Germany

[21] Appl. No.: 801,702

[22] Filed: Feb. 14, 1997

[30] Foreign Application Priority Data

Feb. 16, 1996 [DE] Germany ..... 196 05 736.1

[51] Int. Cl.[6] ..... F02C 9/26

[52] U.S. Cl. ..... 60/39.06; 60/39.281; 60/746

[58] Field of Search ..... 60/39.03, 39.06, 60/39.091, 39.27, 39.281, 737, 746, 747

[56] References Cited

U.S. PATENT DOCUMENTS 5,024,055 6/1991 Sato et al. ..... 60/39.281

5,327,718 7/1994 Iwata et al. ..... 60/39.03

5,469,700 11/1995 Corbett et al. ..... 60/39.281

5,533,329 7/1996 Ohyama et al. ..... 60/39.03

*Primary Examiner*—Louis J. Casaregola

*Attorney, Agent, or Firm*—McGlew and Tuttle

[57] ABSTRACT

A process and a device for quickly switching over from the premixing operation to the diffusion operation in combustion chambers of a gas turbine upon the extinction of the premixing flame or upon the occurrence of a disturbance that may lead to the extinction of the premixing flame. A pilot gas line, into which a pilot gas control valve is inserted, branches off from the fuel gas supply line before the fuel gas valve. The fuel gas supply line branches into fuel supply lines for both combustion chambers after the fuel gas control valve with displacement measurement. The fuel supply to the diffusion gas line and to the premixing gas line is controlled by installing a quick switch-over valve each with servo valves in the branching fuel supply lines. The combustion chambers are monitored in the area of the flame tube by pressure-measuring devices and by an optical flame-monitoring device. The displacement transducer, the monitoring devices, and the servo valves of the quick switch-over valves are wired with a triggering logic unit for quick switch-over.

8 Claims, 2 Drawing Sheets

PROCESS AND APPARATUS FOR QUICKLY SWITCHING OVER FROM PREMIX COMBUSTION TO DIFFUSION COMBUSTION IN A GAS TURBINE

FIELD OF THE INVENTION

The present invention pertains to a process and a device for quickly switching over from the premixing operation to the diffusion operation in gas turbines with at least one combustion chamber with simultaneous triggering of the diffusion- and premix-adjusting valves in the fuel gas supply lines, i.e., opening of the diffusion gas path and simultaneous closing of the premixing gas path of a burner during a rapid reduction in load and extinction of the premixing flame.

BACKGROUND OF THE INVENTION

In the case of the low-$NO_x$ operation of gas turbines with one or even more combustion chambers, fuel gas and air are mixed possibly homogeneously in a mixing system, a premixing burner. Thus, zones of stoichiometric combustion with correspondingly high temperatures are thus avoided in the flame, and $NO_x$ is thus extensively prevented from forming.

Such a burner can be operated in both the so-called diffusion operation and the premixing operation. Zones with stoichiometric combustion and consequently high temperature, which lead to the formation of $NO_x$, also exist in the flame during the diffusion operation. The burner operates as a diffusion burner at start-up, and as soon as the gas turbine has reached a certain output, it is switched over to operation as a premixing burner. The premixing flame is stabilized by a small pilot flame.

Gas turbines are used, e.g., to drive pipeline compressors and generators.

The fuel gas control valve closes very quickly in the case of abrupt reductions in load (surging, generator load shedding, etc.) in order to prevent the speed of rotation of the turbine from increasing.

This means that the fuel supply is drastically reduced while the amount of air of the gas generator is initially nearly unchanged, as a result of which the air-fuel ratio increases and the mixture becomes even leaner.

If this happens in the diffusion operation, i.e., with a diffusion flame, it is not critical, because the flame does not go out. However, the flame, which is already lean in itself, may go out during the premixing operation as the mixture is becoming even leaner, and it can subsequently reignite in an uncontrolled manner.

The reignition takes place either due to the pilot gas flame still burning, or due to hot parts in the combustion chamber or in the hot gas area of the gas turbine. This reignition takes place in an uncontrolled manner and takes place in the form of an explosion or even detonation.

A premixing burner with integrated diffusion burner has been known from DE 32 41 162, in which the premixing burner has a premixing chamber, which is limited by a flame holder at the downstream end and into which opens a main fuel nozzle, and in which the diffusion burner has a pilot fuel nozzle. The entire amount of the combustion air is supplied via a feed means opening into the premixing chamber.

A fuel control device controls the fuel supply in such a way that an exclusive diffusion burner operation becomes established at start-up, then a diffusion burner and premixing burner operation, and a premixing burner operation becomes established in the upper load range.

The fuel control device, to which a load signal is sent, controls the flow through the fuel control valve via corresponding triggering lines.

So-called two-way valves, which control the fuel supply between minimum flow and maximum flow, are used here as fuel control valves. However, control devices which make possible a quick switch-over during unstable operation are not arranged here.

Moreover, a process has been known wherein the gas turbine operates as a generator drive, in which the combustion chamber and the burner in the case of load jumps or load shedding switches over from premixing operation to diffusion operation. The speed gradient of the gas turbine is used to recognize these transient operation processes. If this criterion recognizes a load jump, the diffusion-adjusting valves are closed. The floating time of the valves is 5 sec. In the case of load shedding, the amount of pilot gas is increased via a 2/2-way valve with a floating time of about 150msec, and a so-called quick switch-over is performed.

The drawbacks of this control process are that

- an extinguished premixing flame reignites during the premixing operation, so that there is a risk of explosion or detonation, and
- the flames cannot be influenced during the simultaneous switching over of the control valves. The premixing flame may go out, reignite, or cause an explosion within this time despite the increase in the supporting action of the pilot flame.

SUMMARY AND OBJECTS OF THE INVENTION

The object of the present invention is to provide a control process for the quick switch-over from premixing operation to diffusion operation in order to prevent explosions and detonations of the fuel in the combustion chamber or in the hot gas area during premixing operation, which are associated with an uncontrolled reignition of the premixing flame, from occurring.

According to the invention, a process is provided for quickly switching over from a premixing operation to a diffusion operation in gas turbines with at least one combustion chamber and with simultaneous triggering of the diffusion- and premix-adjusting valve in the fuel gas supply lines, i.e., of the opening of the diffusion gas path and simultaneous closing of the premixing gas path of the burner in the case of a rapid reduction in load and extinction of the premixing flame. A switching over from the premixing operation to the diffusion operation is initiated by a first switch-over criterion when a transient process, which could lead to the extinction of a premixing flame, is recognized early. A switching over from the premixing operation to the diffusion operation is initiated by a second switch-over criterion when the extinction of a premixing flame is recognized early, for which purpose the displacement measurement (Z) of the fuel gas control valve in the fuel gas supply line is continuously transmitted to a triggering logic unit for quick switch-over in the case of the first switch-over criterion, and the pressure measurement (P) in the combustion chamber(s) is continuously transmitted to a triggering logic unit for quick switch-over in the case of the second switch-over criterion. The triggering logic unit for quick switch-over continuously checks the measured values entered by means of the criteria entered, and when the first switch-over criterion or the second switch-over criterion is met, it transmits a triggering signal to the servo valve (V) of a quick switch-over valve in the fuel gas supply line, as a result of which the fuel feed in the premixing gas line to the burner(s) is abruptly interrupted and the diffusion gas line to the burner(s) is immediately supplied with fuel gas.

A third switch-over criterion for the switching over from the premixing operation to the diffusion operation is preferably additionally continuously transmitted by an optical flame monitoring means at the outlet of the burner(s) in the flame tube to a triggering logic unit for quick switch-over, and the triggering logic unit also continuously checks these measured values entered together with the measured values of the first switch-over criterion and the second switch-over criterion. If the third switch-over criterion is met, it also transmits a triggering signal to the servo valve (V) of the quick switch-over valve of the fuel gas supply line.

According to a further aspect of the invention, a device for carrying out the process for quickly switching over from premixing operation to the diffusion operation of a combustion chamber of a gas turbine is provided. One quick switch-over valve with a servo valve (V), which is connected to the burner by a diffusion gas line and by a said premixing gas line, is inserted per the burner into the fuel gas supply line after the fuel gas control valve with the said displacement transducer (Z).

The devices for pressure measurement (P) and for optical flame monitoring (B) are preferably arranged at the combustion chamber. A triggering logic unit for quick switch-over is preferably wired with the displacement transducer (Z) for the fuel gas control valve, with the pressure-measuring devices (P) and with the devices for optical flame monitoring (B) at the said combustion chamber, as well as with the servo valves (V) of the quick switch-over valves. The triggering logic unit for quick switch-over preferably has a switch-over criterion for the displacement transducer (Z) of the fuel gas control valve and second switch-over criterion for the pressure measurement (P), as well as a parallel triggering means of the servo valves (V) of the quick switch-over valves. The triggering logic unit for quick switch-over preferably has the third switch-over criterion for the optical flame monitoring (B) as well as a triggering means of the servo valves (V) of the quick switch-over valves.

To avoid pressure surges caused by explosions and instabilities of the premixing flame, quick switch-over valves are installed according to the present invention in the premixing gas line, with connection to the diffusion gas burner, and these valves switch over from the premixing operation to the diffusion operation within about 100 msec when such a process—extinction of the premixing flame or the appearance of a disturbance that may lead to the extinction of the premixing flame—is recognized, so that an uncontrolled reignition of the premixing flame is ruled out.

Three switch-over criteria were determined for recognizing or detecting this flame instability and for triggering the quick switch-over, and their effectiveness was tested. These switch-over criteria trigger a quick switch-over if

- the fuel gas control valve quickly closes by a certain amount,
- or a quick drop in pressure by a certain amount is recognized within the flame tube,
- or the quick-acting optical flame monitoring means reports extinction of the premixing flame.

By arranging an extremely quickly switching 3/2-way valve in the fuel gas supply line to the combustion chamber (s), the amount of fuel gas available for the combustion can be sent from the premixing gas supply line to the diffusion gas line and thus to the diffusion burner within about 100 msec.

One exemplary embodiment of the present invention will be explained on the basis of two schematic control diagrams.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
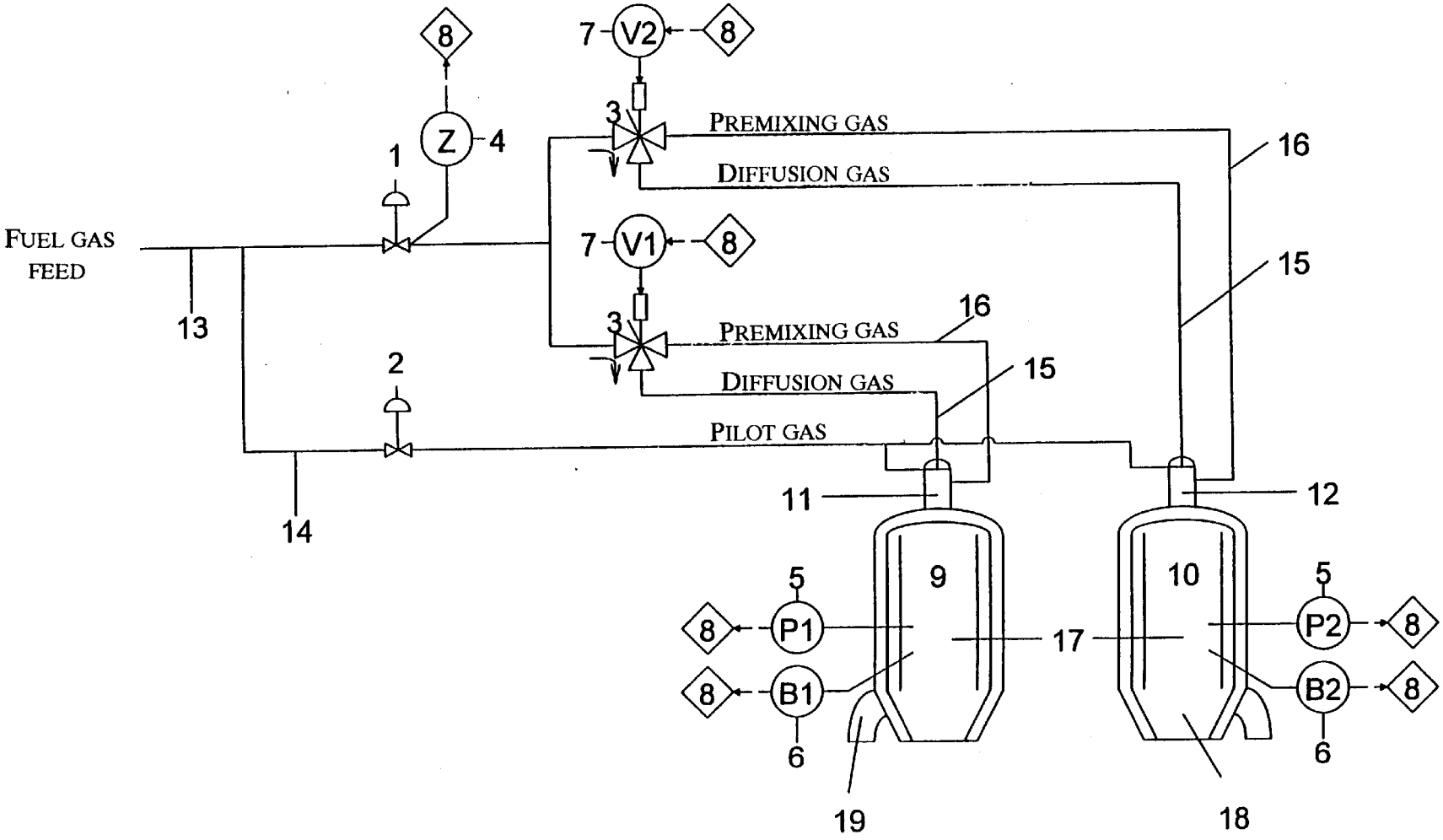
FIG. 1 is a diagram showing the control process for two combustion chambers with one burner each.

Referring to the drawings in particular, FIG. 1 shows the control process according to the present invention including the devices belonging to it for operating a gas turbine with two burners 11, 12 at the combustion chambers 9, 10. The combustion chambers 9, 10 are designed as a flame tube 17 in the upper part and as a mixing tube 18 with the inlet elbow 19 for feeding in compressor air or combustion air in the lower part. Fuel gas is fed to the burners 11, 12 via a fuel gas supply line 13 A pilot gas line 14, in which the fuel feed is controlled by a pilot gas control valve 2, branches off before the fuel gas control valve 1 with the displacement transducer (Z) 4.

The fuel gas supply line 13 branches into fuel supply lines for both combustion chambers 9, 10 after the fuel gas control valve 1, 4. The fuel feed to the diffusion gas line 15 and to the premixing gas line 16 is controlled by installing a quick switch-over valve 3 each with servo valves ($V_1$, $V_2$) 7 in the branching fuel supply lines 13.

The combustion chambers 9, 10 are monitored in the area of the flame tube 17 by pressure-measuring devices ($P_1$, $P_2$) 5 and by an optical flame-monitoring means ($B_1$, $B_2$) 6.

The path transducer or displacement transducer (Z) 4, the monitoring devices for pressure measurement ($P_1$, $P_2$), the monitoring devices for optical flame monitoring ($B_1$, $B_2$) 6, and the servo valves (Z) 7 of the quick switch-over valves 3 are wired with a triggering logic unit for quick switch-over 8.

Figure 2:
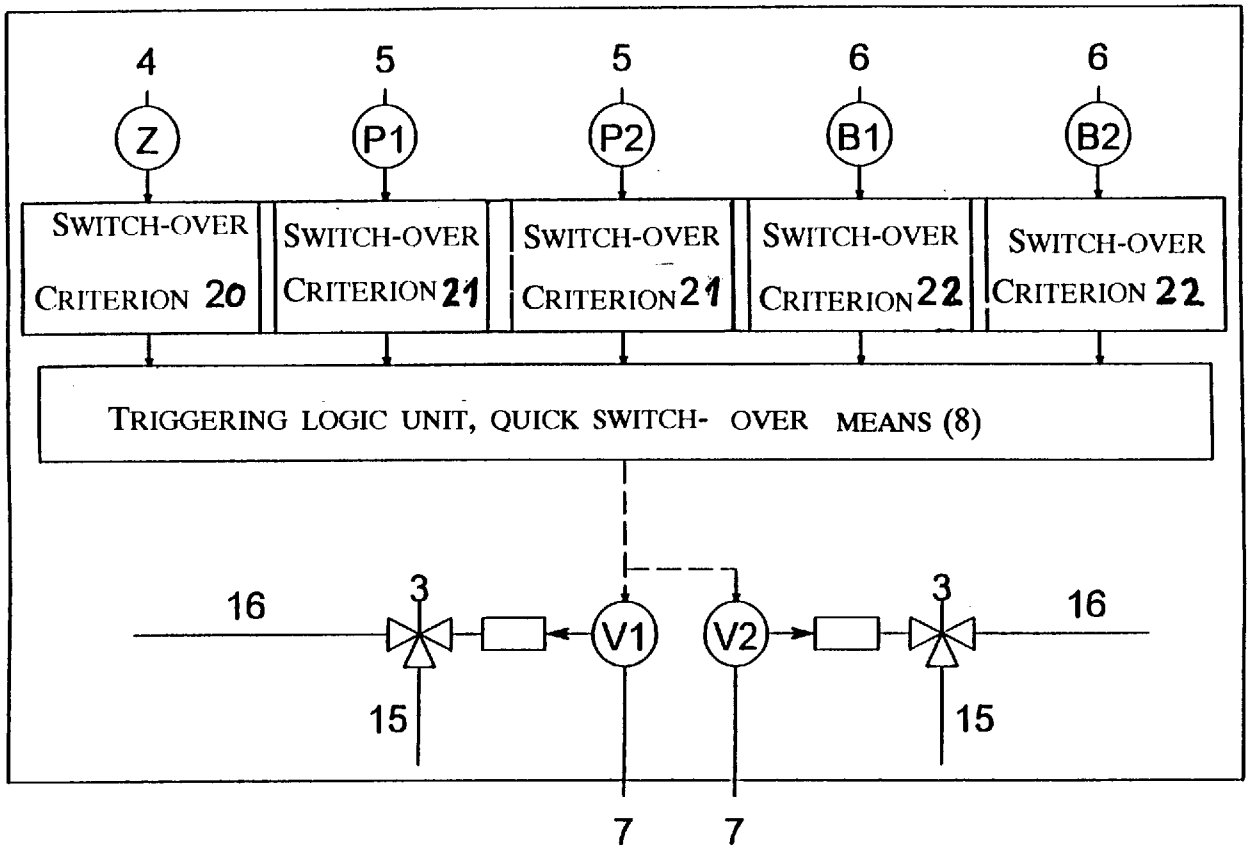
FIG. 2 is a control diagram of the triggering logic unit of a quick switch-over means.

FIG. 2 shows the design of the triggering logic unit of quick switch-over 8, which contains a total of three switch-over criteria for switching over from the premixing operation to the diffusion operation in the case of two burners. Additional switch-over criteria may be added as needed.

The first switch-over criterion 20 is the displacement measurement (Z) 4 of the fuel gas valve 1; the second switch-over criterion 21 is the pressure measurement ($P_1$, $P_2$) 5 in the flame tube 17; and the third switch-over criterion 22 is the optical flame monitoring ($B_1$, $B_2$) 6 in the flame tube 17 of the combustion chamber 9, 10.

The triggering logic unit of the quick switch-over 8 brings about a simultaneous triggering of the servo valves $V_1$, $V_2$ 7 for the quick switch-over valves 3, which bypasses the amount of fuel gas from the premixing gas line 16 into the diffusion gas line 15 within about 100 msec, immediately after evaluation of the measurement results entered for the switch-over criteria 20 and 21 or for all three switch-over criteria 20, 21 and 22.

While a specific embodiment of the invention has been shown and described in detail to illustrate the application of the principles of the invention, it will be understood that the invention may be embodied otherwise without departing from such principles.

APPENDIX
List of Reference Numbers:

1 Fuel gas control valve
2 Pilot gas control valve
3 Quick switch-over valve
4 Displacement transducer, displacement measurement
5 Pressure measurement, combustion chamber $P_1$, $P_2$
6 Optical flame monitoring of the combustion chamber, $B_1$, $B_2$
7 Servo valves $V_1$, $V_2$
8 Triggering logic unit, quick switch-over valves
9 Combustion chamber 1
10 Combustion chamber 2
11 Burner 1
12 Burmer 2
13 Fuel gas supply line
14 Pilot gas line
15 Diffusion gas line
16 Premixing gas line
17 Flame tube
18 Mixing tube
19 Compressor air inlet elbow
20 Switch-over Criterion "displacement measurement, fuel gas control valve"
21 Switch-over criterion "pressure measurement"
22 Switch-over criterion "flame monitoring"

What is claimed is:

1. A process for quickly switching over from the premixing operation to the diffusion operation in gas turbines with at least one combustion chamber with a burner, the process comprising the steps of:

simultaneously triggering a diffusion-adjusting valve and a premix-adjusting valve in the fuel gas supply lines to open a diffusion gas path and simultaneous close a premixing gas path of the burner in the case of a rapid reduction in load and extinction of the premixing flame, including initiating switching over from the premixing operation to the diffusion operation based on a first switch-over criterion when a transient process, which could lead to the extinction of a premixing flame, is recognized early;

initiating switching over from the premixing operation to the diffusion operation based on a second switch-over criterion when the extinction of a premixing flame is recognized early, for which purpose a displacement measurement Z of a fuel gas control valve in a fuel gas supply line is continuously transmitted to a triggering logic unit for quick switch-over in the case of said first switch-over criterion, and a pressure measurement P in the combustion chambers is continuously transmitted to the triggering logic unit for quick switch-over in the case of said second switch-over criterion;

continuously checking with the triggering logic unit, for quick switch-over, measured values entered based on said criteria and when said first switch-over criterion or said second switch-over criterion is met, transmitting with said triggering logic a triggering signal to a servo valve V of a quick switch-over valve in said fuel gas supply line, as a result of which the fuel feed in the premixing gas line to the burners is abruptly interrupted and the diffusion gas line to the burners is immediately supplied with fuel gas.

2. A process in accordance with claim 1, further comprising initiating switching over from the premixing operation to the diffusion operation based in a third switch-over criterion when an optical flame monitoring means B at the outlet of the burners in the flame tube recognizes an extinguished flame by sending an optical flame monitoring signal to a triggering logic unit for quick switch-over, and said triggering logic unit also continuously checks measured values for said third criterion together with the measured values of said first and second switch-over criteria, and if said third switch-over criterion is met, it also transmits a triggering signal to said servo valve V of the quick switch-over valve of said fuel gas supply line.

3. A device for carrying out the process for quickly switching over from premixing operation to the diffusion operation of a combustion chamber of a gas turbine, comprising:

a burner connected to said combustion chamber;

fuel gas supply line diffusion-adjusting valve and a premix-adjusting valve in the fuel gas supply lines to open a diffusion gas path and simultaneous close a premixing gas path of the burner;

a quick switch-over valve with a said servo valve, which is connected to said burner by said diffusion gas line and by said premixing gas line, inserted into said fuel gas supply line downstream of a fuel gas control valve with a displacement transducer; and triggering logic means for initiating switching over from the premixing operation to the diffusion operation based on a first switch-over criterion when a transient process, which could lead to the extinction of a premixing flame, is recognized early;

initiating switching over from the premixing operation to the diffusion operation based on a second switch-over criterion when the extinction of a premixing flame is recognized early, for which purpose a displacement measurement Z of said fuel gas control valve in a fuel gas supply line is continuously transmitted to a triggering logic unit for quick switch-over in the case of said first switch-over criterion, and a pressure measurement P in the combustion chambers is continuously transmitted to the triggering logic unit for quick switch-over in the case of said second switch-over criterion, said triggering logic means sending a triggering signal to said servo valve in said fuel gas supply line, as a result of which the fuel feed in the premixing gas line to the burners is abruptly interrupted and the diffusion gas line to the burners is immediately supplied with fuel gas.

4. A device in accordance with claim 3, wherein said triggering logic means further initiates switching over from the premixing operation to the diffusion operation based in a third switch-over criterion when an optical flame monitoring means B at the outlet of the burners in the flame tube recognizes an extinguished flame by sending an optical flame monitoring signal to said triggering logic unit for quick switch-over, and said triggering logic unit also continuously checks measured values for said third criterion together with the measured values of said first and second switch-over criteria, and if said third switch-over criterion is met, it also transmits a triggering signal to said servo valve V of the quick switch-over valve of said fuel gas supply line.

5. A device in accordance with claim 3, wherein devices for pressure measurement and for optical flame monitoring are arranged at said combustion chamber.

6. A device in accordance with claim 5, wherein said triggering logic means is wired with the said displacement transducer for said fuel gas control valve, with said pressure-measuring devices P and with said device for optical flame monitoring at said combustion chamber as well as with said servo valves of said quick switch-over valves.

7. A device in accordance with claim 3, wherein said triggering logic unit for quick switch-over has said first switch-over criterion for the displacement transducer of said fuel gas control valve and said second switch-over criterion for said pressure measurement, as well as a parallel triggering means of said servo valves of said quick switch-over valves.

8. A device in accordance with claim 3, wherein said triggering logic unit for quick switch-over has a switch-over criterion for the optical flame monitoring as well as a triggering means of said servo valves of said quick switch-over valves.

* * * * *